United States Patent [19]

Perr

[11] Patent Number: 4,934,344

[45] Date of Patent: Jun. 19, 1990

[54] MODIFIED FOUR STROKE CYCLE AND MECHANISM

[75] Inventor: Julius P. Perr, Columbus, Ind.

[73] Assignee: Cummins Engine Company, Inc., Columbus, Ind.

[21] Appl. No.: 346,748

[22] Filed: May 3, 1989

[51] Int. Cl.[5] ..... F02B 75/26

[52] U.S. Cl. ..... 13/58 A; 123/311

[58] Field of Search ..... 123/197 AC, 58 A, 58 AA, 123/58 AB, 59 A, 311, 48 B, 78 F, 78 B, 78 E

[56] References Cited

U.S. PATENT DOCUMENTS

| | | | |
|---|---|---|---|
| 1,528,164 | 3/1925 | Nordwick | 123/197 R |
| 1,624,269 | 4/1927 | Marchetti | 123/197 R |
| 1,728,363 | 9/1929 | Rightenour | 123/78 F |
| 2,004,498 | 7/1935 | Dassett . | |
| 2,340,010 | 1/1944 | Miller | 123/78 F |
| 3,025,840 | 3/1962 | Casini . | |
| 3,735,741 | 5/1973 | Hatz | 123/197 R |
| 4,301,695 | 11/1981 | Reiher | 123/78 F |
| 4,517,931 | 5/1985 | Nelson | 123/48 B |

*Primary Examiner*—David A. Okonsky

*Attorney, Agent, or Firm*—Sixbey, Friedman, Leedom & Ferguson

[57] ABSTRACT

An internal combustion engine is disclosed with a modified four stroke cycle which takes place during a single crankshaft revolution, wherein a reciprocating piston moves through a compression stroke and power expansion stroke, each having a short duration, and an exhaust stroke and intake stroke, each having a relatively long duration compared to the intake and power strokes. The piston stroke distance for each of the aforementioned strokes is equal, defined by, in the preferred embodiment, a first and second cam lobe on the crankshaft, wherein one lobe extends over less of the crankshaft, radial periphery than the other lobe. Preferably, the lobe defining the compression and power strokes act during only 90° of crankshaft revolution while the other lobe act during the remaining 270° of revolution.

19 Claims, 5 Drawing Sheets

MODIFIED FOUR STROKE CYCLE AND MECHANISM

TECHNICAL FIELD

This invention relates to a four stroke diesel cycle which is altered such that the four strokes are accomplished within a single crankshaft revolution to thereby produce the power equivalent of a standard cycle engine, but which is delivered at one-half the rpms. Particularly, the cycle is modified so that the compression and power expansion strokes occur over a shorter duration than that of the intake and exhaust strokes.

BACKGROUND ART

Internal combustion engine design has been continuously modified in numerous different ways ever since the introduction thereof. The motivation for these design changes has historically stemmed from the desire to increase the engine efficiency. Moreover, most attempts are made to improve efficiency reliability and/or increase the power output from the internal combustion engine. One known variety of improvements includes the modification of a conventional engine cycle with a four stroke cycle that is completed during a single revolution of an engine crankshaft. A four stroke engine cycle is defined as including an intake stroke, a compression stroke, a power expansion stroke and an exhaust stroke. To complete each of these aforementioned strokes, at least one piston is moved twice in a reciprocating manner within a cylinder bore from a top dead center position (hereinafter abbreviated TDC) to a bottom dead center position (hereinafter abbreviated BDC). Typically, four strokes occur over two revolutions of the engine crankshaft wherein a first revolution defines the compression and expansion strokes and the second revolution defines the exhaust and intake strokes. The crankshaft is rotatably mounted to an engine block and is provided with an offset crank portion that is rotatably connected to a connecting rod, which is further rotatably connected to a wristpin affixed with the piston. By this, the reciprocating piston motion is translated to rotary motion, wherein only a single power stroke is completed for every two revolutions.

In order to complete a four stroke cycle within a single crank revolution, it becomes necessary to conduct one power stroke for each crankshaft revolution. In order to accomplish this the piston must travel through two reciprocating motions during the single revolution of the crankshaft. The above mentioned rotatable connection, included in a conventional four stroke cycle, between a connecting rod and the crankshaft cannot facilitate this type of motion.

Attempts at making a crankshaft, that can facilitate two reciprocations of the piston during one revolution, have been basically focused on two areas. One of these areas has been to use a rotatable camshaft as the crankshaft, wherein the camshaft includes dual cam lobes, and each lobe corresponds to one piston reciprocation equal in duration to the second piston reciprocation. Known devices include an element extending from the piston to ride against the cam surface of the camshaft, wherein the element, such as a roller, follows along each of the cam lobes of the camshaft. Therefore, the power stroke of the piston and attached element imparts the rotational drive force to the camshaft during one inward piston stroke of every camshaft rotation.

The use of roller elements provided on extensions from the piston and a cam lobed crankshaft is not limited to internal combustion engines of the variety above described. Such a cam operated crankshaft is of use in a conventional type four stroke cycle wherein one revolution translates into one reciprocal motion of the piston. Examples of cam driven shafts are disclosed in U.S. Pat. No. 2,004,498 to Dasset and No. 3,025,840 to Casini.

The second area of focus of four stroke single revolution engines, includes devices utilizing linkage systems which allow the piston to be reciprocated twice during a single revolution of the driven output shaft. In order for these linkage systems to work, it is necessary to include a drive link extending from the piston, with the distal end thereof moved from side to side across the longitudinal axis of the piston and cylinder. Such movement provides two piston reciprocations to a single revolution of a crankshaft, wherein the crankshaft is attached by link to the distal end of the drive link. These devices are disadvantageous in that they require a relatively large amount of moving parts and more importantly require a large operating area. Such devices are impractical for commercial use because they increase the size and weight of the engine as well as the costs thereof.

Internal combustion engines are also known with variable stroke mechanisms for increasing the power output from the engine and thus increasing the efficiency thereof. An example of a variable stroke engine is disclosed by Nelson U.S. Pat. No. 4,517,931. This patent illustrates an increased power output by having a longer power stroke and exhaust stroke than the intake stroke and compression stroke. However, this mechanism requires a complex trunion assembly and a control shaft connected by a control link to thereby variably permit a longer downward stroke for the power stroke.

SUMMARY OF THE INVENTION

Thus it is a primary object of the invention to provide an internal combustion engine having a diesel cycle in which four strokes of the cycle are accomplished within one crankshaft revolution which effectively overcomes the aforenoted shortcomings of the prior art cycles and mechanisms.

It is a further object to provide an internal combustion engine having a diesel cycle including at least one piston reciprocibly mounted within a cylinder bore of the engine, wherein the piston moves through a four stroke cycle during a single crankshaft revolution, and the timing of successive piston inward and outward strokes are modified to vary the time duration thereof.

It is a further object to provide an internal combustion engine of the type including at least one piston reciprocally mounted within a cylinder bore of the engine, wherein the piston moves through a four stroke cycle including an intake stroke, a compression stroke, a power expansion stroke and an exhaust stroke, wherein the compression stroke and the power expansion stroke take place during less than 180° of a single crankshaft revolution and the exhaust stroke and intake stroke act during the remaining single crankshaft revolution.

It is a still further object to provide an internal combustion engine having a four stroke cycle including an intake stroke, a compression stroke, a power expansion stroke and an exhaust stroke, wherein the compression stroke and power expansion stroke are completed within 90° of turning of the engine crankshaft, and the intake and exhaust strokes are completed during the remaining 270° of revolution. The short duration of the compression and expansion strokes results in benefits from better air/fuel mixing and less heat rejection, and the longer duration of the intake and exhaust strokes decrease pumping losses.

It is yet another object of this invention to provide an internal combustion engine having a four stroke cycle that is completed within a single crankshaft revolution including a piston reciprocably mounted within a cylinder bore of the engine, wherein the piston stroke for each stroke of the four cycle are of equal distance, and the timing of the strokes in each cycle are modified so that one inward and outward stroke takes place over a lesser crankshaft revolution than the second inward and outward stroke.

It is yet a further object of the present invention to provide an internal combustion engine having a four stroke cycle which takes place during a single crankshaft revolution, wherein the compression stroke and power expansion stroke each have a short duration as compared to the exhaust stroke and intake stroke which have a long duration. The short duration compression stroke is advantageous in that it improves the air/fuel mixing and reduces heat rejection. The short duration power stroke is optimum when properly matched to the heat release rate, wherein such a configuration advantageously provides for a low fuel consumption as compared to a standard cylinder, and lower hydro carbon and particulate emissions with reduced heat rejection. A long duration intake stroke results in minimum pumping losses and improved volumetric efficiency, provided the piston displacement to valve/port flow area is properly matched. Likewise, the long duration exhaust stroke with properly matched piston displacement to valve/port flow area, results in minimum pumping losses as well as reducing the sensitivity of high efficiency/high cost turbo chargers. This modified four stroke cycle results in an improved load efficiency due to the improved efficiency from the reduced pumping loss, the reduced heat loss, and the proper placement of the heat release rate. Thus, an improved internal combustion engine with improved thermal efficiency can be made with a minimum number of moving parts.

Further and additional objects and advantages will appear from the description, accompanying drawings and appended claims.

The above noted objects of the invention and others not specifically referred to, but nevertheless readily apparent to those skilled in the art, may be accomplished by providing an internal combustion engine including at least one piston reciprocably mounted within a cylinder bore of the engine block, and a crankshaft or output shaft rotatably mounted to the engine block to be in cooperation with a follower means extending from the piston. The crankshaft is designed to guide the piston through a complete four stroke cycle including an intake stroke, a compression stroke, a power expansion stroke and an exhaust stroke within one revolution of the crankshaft. Preferably, the crankshaft includes first and second cam lobes defining the radial periphery of the crankshaft at the point of engagement with the follower means of the piston. The two lobes together define a guide surface along which the follower means rides in association with the piston movements defining each stroke. The first and second cam lobes extend radially outward from the crankshaft to an equal distance from the axis of rotation of the crankshaft, thereby defining an equal piston stroke distance for each stroke of the cycle. The cam lobe which corresponds in timing to the compression and power expansion strokes extends over no more than 90° of the crankshaft's radial periphery, and the other lobe extends over the remaining 270° of the crankshaft radial periphery. This cam orientation results in a quick compression and power expansion stroke; each stroke of which has only a short duration, and the other lobe results in a significantly longer exhaust and intake stroke; each stroke of which has a longer duration. Preferably, the follower means provided on the piston is a roller that is rotatably mounted to a connecting rod extension from the piston. Additionally, in order to facilitate the inward motion of the piston (that is toward the crankshaft) a bias means is also provided urging the piston inward to keep the follower means against the guide edges of the cam lobes. Such a bias means is of particular importance to ensure that the piston follows the crankshaft during the intake stroke, whereas the piston follows the crankshaft during the power expansion stroke by virtue of the timed combustion of fuel in the chamber above the piston for driving the crankshaft and producing output power. One embodiment for biasing the piston inwardly comprises a pivoted link that is further connected to the piston connecting rod and a camshaft drivingly connected to the crankshaft such that the camshaft includes a lobe to engage a surface on the link which forces the link and the piston inward. The cam lobe is appropriately timed in relation to the crankshaft lobe.

For a more complete understanding of the invention reference should be made to the following detailed description taken in conjunction with the accompanying drawings.

DETAILED DESCRIPTION

Figure 1:
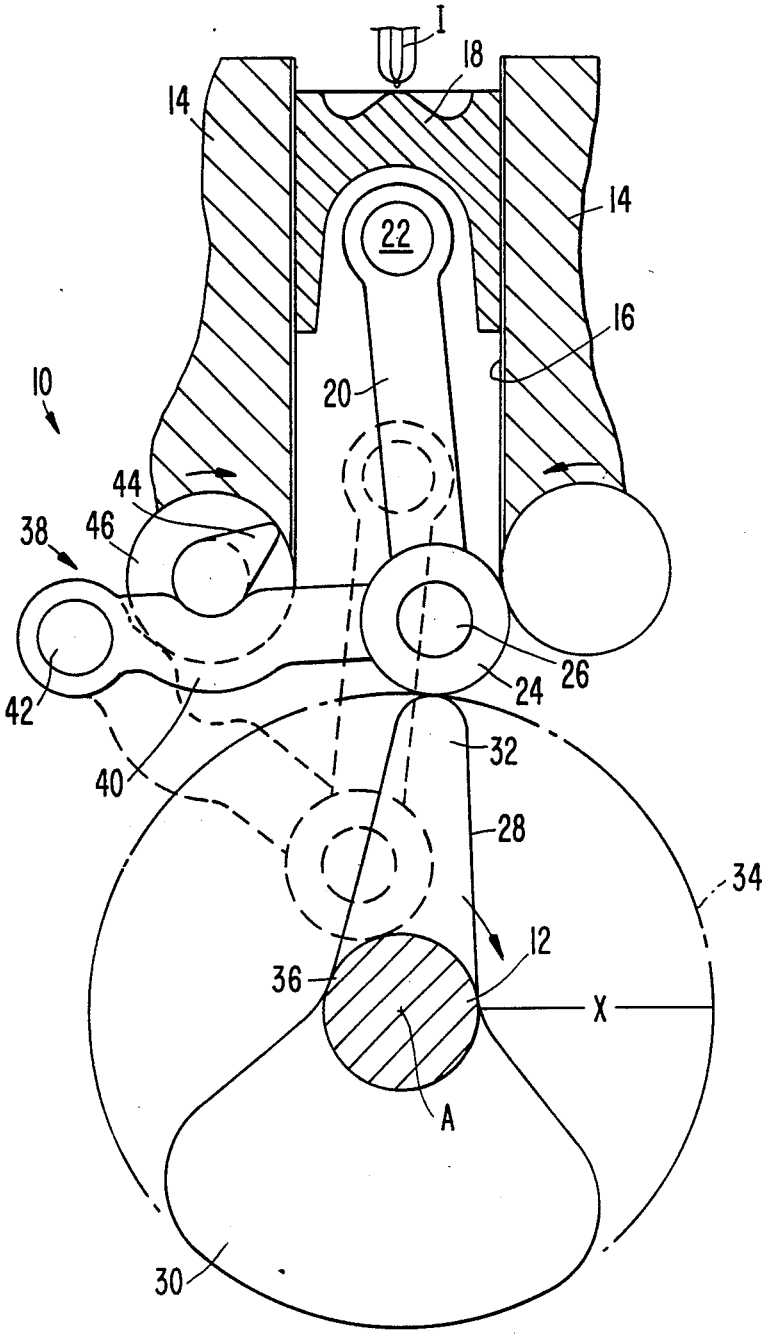
FIG. 1 is a schematic illustration of an internal combustion engine designed in accordance with the present invention with the piston at the top dead center position just before ignition and the crankshaft at 0° rotation.

Referring now to the figures, wherein like reference numerals designate like or corresponding parts throughout the figures, and in particular to FIG. 1, an internal combustion engine 10 is disclosed in which the intake stroke, compression stroke, power expansion stroke and exhaust stroke take place within a single revolution of crankshaft 12. In the course of this description, the term inward refers to the direction of travel toward the axis of rotation A and outward is defined as the direction of travel opposite thereto.

The internal combustion engine 10 comprises a block 14, as is conventionally known, including a water jacket and oil ports (not shown) and at least one head (not shown) that includes intake supply passages, exhaust passages and valve assemblies which are controlled to selectively open and close the intake and exhaust passages. Such head assemblies are conventionally known. The head assembly may also be of the fuel injection type which would include passages for intake air and exhaust controlled by valve assemblies, as well as a fuel injector such as shown at I in FIG. 1. It is also noted that a conventional spark plug or glow plug would be mounted within the head assembly to extend into the combustion chamber. The block 14 includes at least one bore 16 into which a piston 18 is reciprocibly mounted. Likewise, the piston can be of conventional design including compression and oil rings.

The piston 18 is connected with a connecting rod 20 by a wristpin 22 thereby allowing the connecting rod 20 to rotate about the axis of wristpin 22 relative to the piston 18. At the distal end of the connecting rod 20, a cam follower means is attached including a roller 24 pivotally mounted by pin 26. A roller such as shown at 24 is preferable for reduced wear between the follower means and the crankshaft 12, however it is understood that many other elements could be substituted therefore such as a nonrotating slide surface provided at the distal end of the connecting rod 20, which may include a friction lessening coating. The cam follower means such as roller 24 rides along a guide surface 28 defined by the radial peripheral extent of the crankshaft 12.

The crankshaft 12 includes a first reciprocating means or cam lobe 30 which corresponds to the exhaust stroke and intake stroke of the modified four stroke cycle of the present invention, as will be more apparent below with reference to FIG. 2. A second reciprocating means or cam lobe 32 is also provided on the crankshaft 12 and corresponds to the compression stroke and power expansion stroke of the four stroke cycle as also amplified below. Each of the cam lobes 30 and 32 extend radially outward to a maximum distance defined by the chain-line circle 34 from a central circular hub portion 36. The distance X between inner hub 36 and the outer circle 34 corresponds to the stroke distance of piston travel. This configuration ensures that each stroke of the four stroke cycle is of equal length, wherein the distance of each is equal to the length X.

FIG. 1 represents piston 18 in its top dead center position, wherein the follower roller 24 is engaged with the guide surface 28 at a point on cam lobe 32 also on the outer circle 34. Also shown in dotted lines is the position of the connecting rod 20 moved inwardly, representing the piston in its bottom dead center position, wherein the roller 24 is maintained in engagement with guide surface 28 at the inner hub 36.

In order to ensure that the roller 24 of the follower means is kept in constant contact with the guide surface 28 along each cam lobe of the crankshaft 12, it is necessary to include a bias means 38. This function can be performed by many different types of bias means, such as: mechanical springs, a hydraulic pressure system, other resilient material, a camshaft arrangement, or any other conventional means. In the embodiment shown in FIG. 1, a cam bias mechanism is illustrated. The cam mechanism includes a guide link 40, which is pivotally mounted at a first end thereof to a portion of the engine block 14 by a pin or stud 42. The other end of the link 40 is rotatably connected to the pin 26 for the roller 24 of the connecting rod 20. Therefor, it is clearly seen that a force applied to the guide link 40, for biasing the guide link 40 inward, will result in a bias applied to the connecting rod 20 and thus piston 18. In order to accomplish this bias force, a biasing cam lobe 44 is provided on a camshaft 46 to engage with the guide link 40. The action of the cam lobe 44 against the guide link 40 causes guide link 40 to rotate about pivot 42 and the piston 18 to move inwardly. The camshaft 46 will also preferably include cam lobes (not shown) used to control the intake and exhaust valves in a manner to appropriately time the opening and closing thereof with the intake and exhaust strokes of the present invention. Such cam lobes would conventionally engage push rods extending through the engine block and the engine head to engage rocker arms for actuating the valves.

Since the present invention requires that the piston travel inwardly twice during a single rotation of the crankshaft 12, two such bias cam lobes 44 can be used, each of which corresponds to an inward stroke of the four stroke cycle. In order to accomplish this, a second biasing cam lobe 44 (not shown) would be used adjacent to the first biasing cam lobe 44 to also engage with the guide link 40 at a different time than the first bias cam lobe such that the guide link is biased inwardly twice (once by each bias cam lobe) during a single rotation of the camshaft 46. Therefore, camshaft 46 can be operatively connected with the crankshaft 12 to rotate with one another in a 1:1 relationship. Typically, this can be accomplished by direct gear engagement or by the use of equal size gears or pullies connected by a chain or belt respectively. When using the camshaft 46 to control the intake and exhaust valves, as noted above, it is necessary that the intake and exhaust cam lobes be appropriately timed with the intake and exhaust strokes of the crankshaft 12 to occur once during each rotation of both the crankshaft 12 and the camshaft 46.

Since the camshaft arrangement for biasing the guide rod 40 and thus piston 18 inwardly requires a fairly high degree of accuracy in timing the bias cam lobes 44 with the inward sloped stroke surfaces of crankshaft cams 32 and 30, the connection of the guide link 40 at either 42 or 26 can be made resilient in order to relieve slight inaccuracies of timing without binding of the engine. This could be simply accomplished by use of rubber or other resilient bushings at either pivot 42 or 26 or at both. Otherwise, other mechanical spring devices or hydraulic devices could easily be incorporated to give the link 40 the desired degree of resiliency providing a leeway tolerance.

It is also noted with respect to the bias means 38, that it is only necessary that a bias force acts during the inward stroke which defines the intake stroke of a four stroke cycle because the other inward stroke is the power expansion stroke wherein the power expansion would force the follower means roller 24 against the guide surface 28. Therefore, the bias cam lobe 44 relating to the power stroke could be eliminated; leaving only one bias cam lobe to correspond to the intake stroke. However, when two such bias cam lobes are used, they are positioned adjacent one another and the guide link 40 has a cam engagement surface that is sufficiently wide at its upper edge to be contacted by both adjacent cam lobes 44. In this respect, the guide link 40 can be located at the plane of contact between the adjacent bias cam lobes 44, or the guide link could include an extension surface (not shown) along a portion of the axial length of the camshaft 46.

The relationship of the guide surface 28 along first and second cam lobe 30 and 32 of the crankshaft 12 with the four stroke cycle of the present invention will now be described with reference to FIGS. 2A–2E.

Figure 2A:
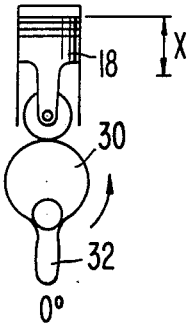
FIGS. 2A through 2E are schematic illustrations of a single cycle in accordance with the present invention, wherein the piston is moved from its top dead center position to its bottom dead center position and back two times for a single crankshaft revolution.
Figure 2B:
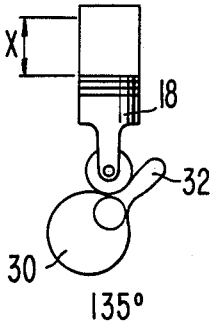
Figure 2C:
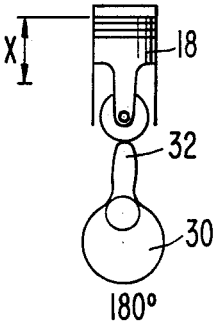
Figure 2D:
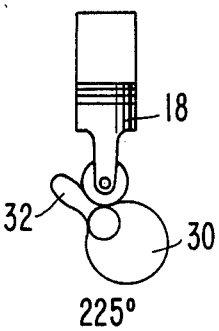
Figure 2E:
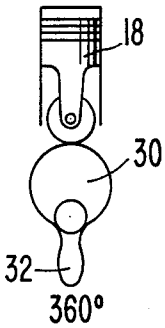

FIG. 2A shows a piston 18 in its top dead center position just after exhaust stroke and approaching the intake stroke. This position is denoted 0° of crankshaft angle. As the crankshaft rotates from the 0° position to the 135° position of FIG. 2B, the piston 18 is moved inwardly to its bottom dead center position thus completing a single intake stroke. Thereafter, the compression stroke is completed as the roller 24 follows the second cam lobe 32 while the piston 18 moves from its bottom dead center position to a second top dead center position at the 180° mark of the crankshaft 12. At this point in the cycle, the combustible mixture from the intake stroke is ignited to produce the power expansion stroke occurring between FIG. 2C and FIG. 2D. In the present invention, the power stroke occurs between the 180° mark and the 225° mark of rotation of the crankshaft 12, while the piston 18 moves to its bottom dead center position. Lastly, the exhaust stroke takes place during the remaining angular rotation of the crankshaft 12 from the 225° mark to the 360° mark, wherein the piston 18 moves to the top dead center position, shown in FIG. 2E and corresponding to the starting position shown in FIG. 2A.

It is therefore clearly seen that the piston 18 moves from its top dead center position inwardly to its bottom dead center position, and outwardly from its bottom dead center position to the top dead center position twice during each single revolution of the crankshaft 12, constituted by 360° of rotation.

It is also understood that the compression and power expansion strokes take place between the 135° and 225° mark which is only 90° of the total crankshaft rotation. The exhaust stroke and intake stroke occur during the remaining 270° of rotation. By this design the exhaust and intake strokes have a relatively long duration and the compression and power strokes have a comparatively short duration. In this illustrated embodiment, it is the size of the cam lobes 30 and 32 which define the intake, compression, power and exhaust strokes in this advantageous manner. The cam lobe 30 has a longer gradual cam surface first defining the exhaust stroke and a long gradual cam surface defining the intake stroke. The cam lobe 32 provides for a very abrupt and short duration compression stroke as well as a cam surface for a short duration power stroke. It is understood that the curvatures and angled surfaces of the cam lobes 30 and 32 can be modified to suit the engine timing, particularly with respect to efficiency. For example, the intake could be more gradual, and/or the compression could be more compact. Likewise, it is most critical that the power be efficiently imported to the crankshaft 12.

Figure 3:
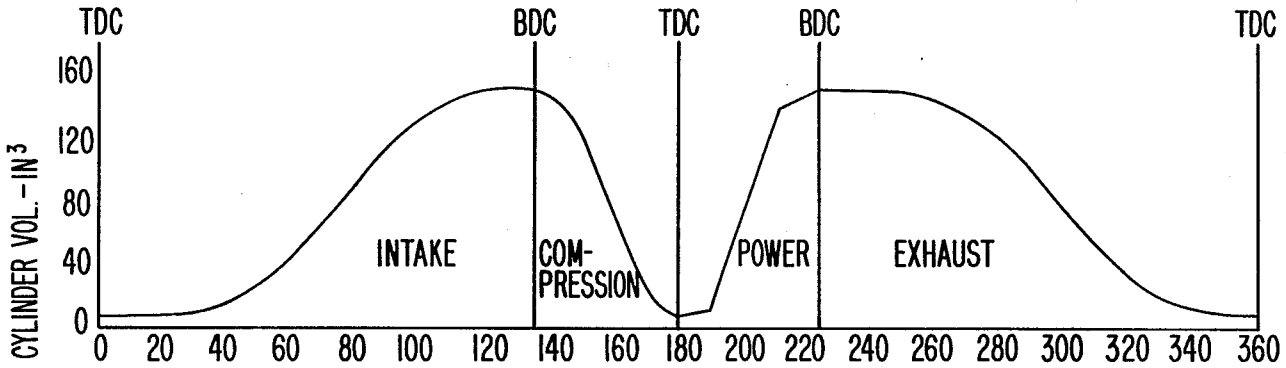
FIG. 3 is a graphical representation comparing the cylinder volume with crankshaft angle through a single cycle of a piston in accordance with the present invention.
Figure 4:
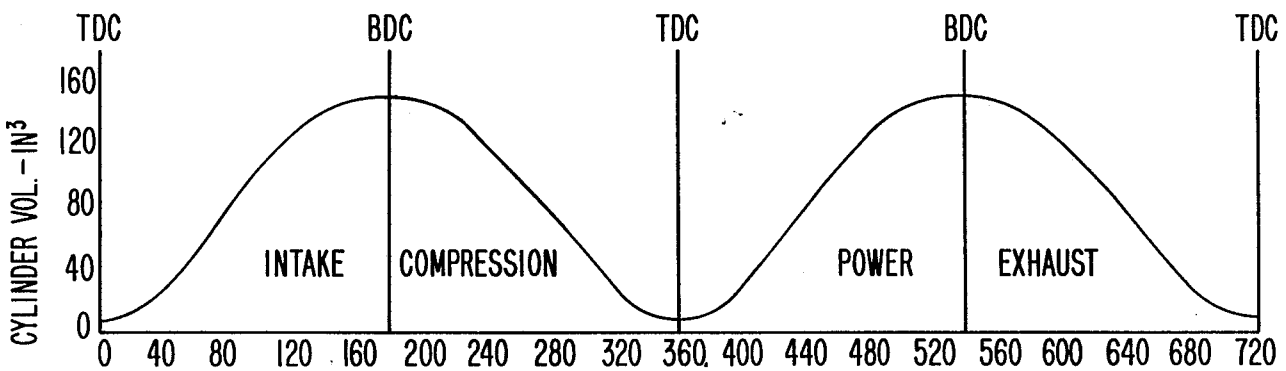
FIG. 4 is a graphical representation comparing cylinder volume with crankshaft angle for a conventional four stroke cycle internal combustion engine taken through a single cycle.

The graphs of FIGS. 3 and 4 compare the cylinder volume during the completion of a single four stroke cycle of the present invention to that of a conventional four stroke engine cycle. As can be seen in FIG. 3 showing the present invention, all four strokes take place within 360° of crankshaft rotation whereas in FIG. 4, the four stroke cycle is completed only after 720° rotation of the crankshaft. FIG. 3 also illustrates that the compression stroke and power stroke take place during the 90° of rotation verses the 270° of rotation utilized for the intake and exhaust strokes. In FIG. 4, all four strokes of a conventional cycle are equally divided to occur over 180° of crankshaft rotation.

Figure 5:
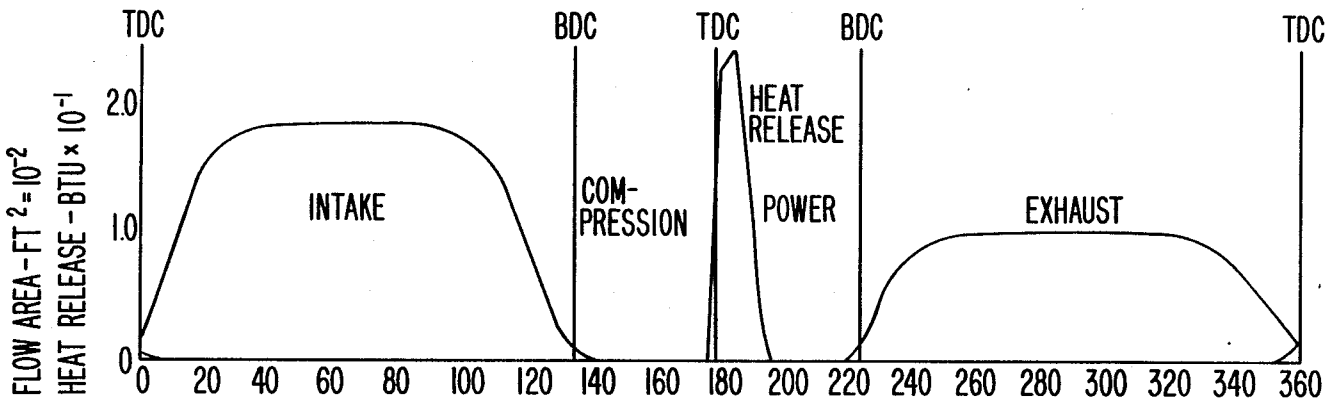
FIG. 5 is a graphical representation comparing flow area and heat release to crankshaft angle through a single cycle in accordance with the present invention.
Figure 6:
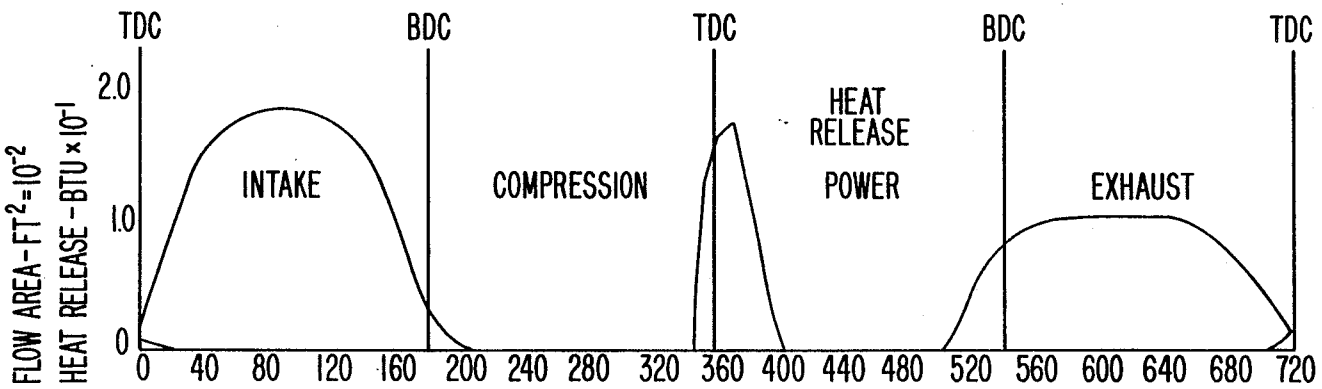
FIG. 6 is a graphical representation comparing flow area and heat release to crankshaft angle through a complete cycle in a conventional internal combustion engine.

The long duration intake stroke and the long duration exhaust stroke result in the minimizing of pumping losses, in that the pumping actions take place more gradually, provided the valve/port flow area is properly matched to the piston displacement. This has been found to be extremely advantageous in that less power is lost for pumping thereby increasing the output horsepower from the cylinder. The short duration compression stroke has been found to improve air/fuel mixing due to the abrupt nature of the compression and to reduce heat rejection. Likewise, the power stroke is better matched to the heat release rate, resulting in lower fuel consumption with lower emissions and reduced heat rejection. The reduction in pumping losses result in an improved volumetric efficiency, illustrated in FIG. 5 at the intake and exhaust strokes, in that greater flow is obtained over a longer period of time than a conventional engine shown in FIG. 6. Likewise, the improved heat release rate of the present invention is shown in FIG. 5 showing how the heat release is more closely matched to the power stroke duration, as compared to the conventional engine in FIG. 6.

Figure 7A:
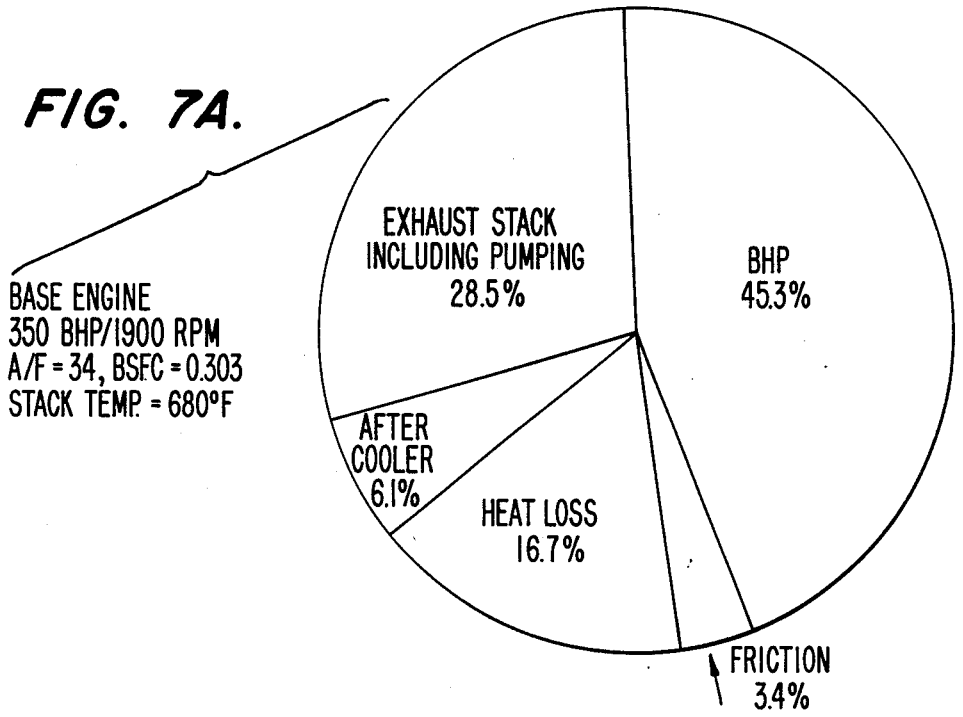
FIG. 7A and 7B illustrate the comparison of heat balance of a conventional base engine to the modified cycle of the present invention.
Figure 7B:
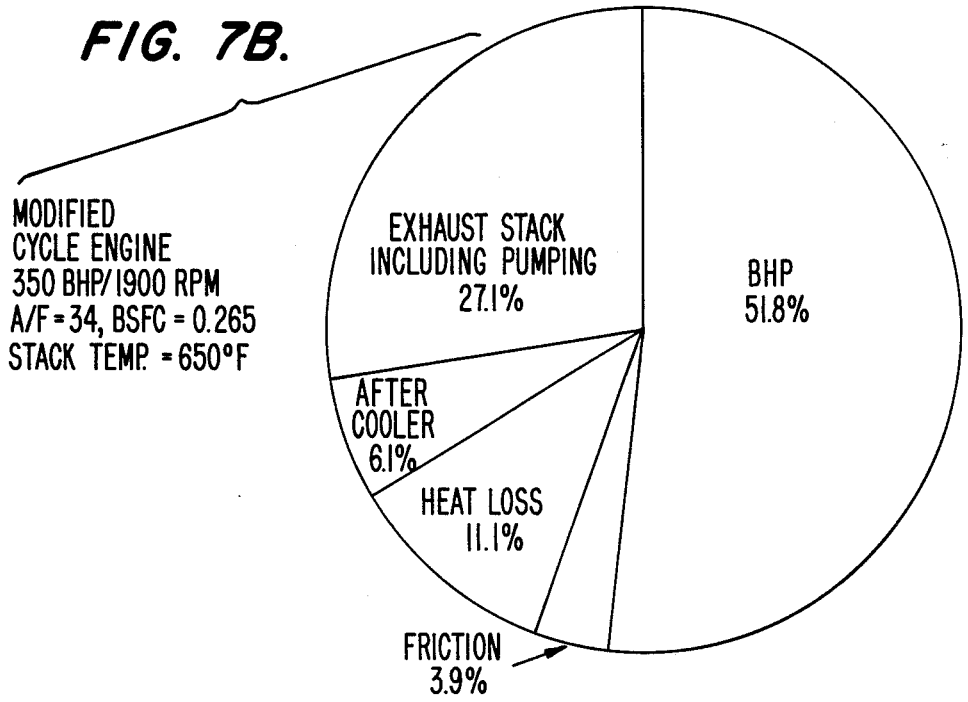

FIGS. 7A and 7B illustrate the comparison of the heat balance of a conventional base engine and the modified cycle engine of the present invention. Both engines have 350 brake horsepower (BHP) at 900 rpms. Both also have an air fuel ratio (A/F) of 34. A comparison of the two pie charts illustrates the heat balance of both engines, wherein 51.8% of the heat goes to the brake horsepower in the modified cycle versus 45.3% in a conventional base engine. This significant difference comes from:

1. reduced heat losses during compression and expansion period;
2. reduced pumping losses during intake and exhaust period; and
3. improved fuel air mixing due to shorter compression period and faster piston motion.

Also, there is less heat in the exhaust stack, wherein the stack temperature of the modified cycle was 30° lower than that of the base engine. Likewise, the fuel consumption efficiency was raised.

The present invention is also advantageous over other modified cycles, such as those discussed in the prior art section of this application, which utilize variable stroke per event cycles. For example, U.S. Pat. No. 4,517,931 discloses a short intake and compression stroke versus a long power and exhaust stroke. Such a cycle does not include the advantages relating to the short and long duration strokes of the present invention in that each stroke occurs over 90° of rotation of the crankshaft. Further, such a cycle is disadvantageous in that the displacement is reduce for the intake stroke, the heat rejection is increased and significant pumping losses occur.

INDUSTRIAL APPLICABILITY

It is understood that the present invention is applicable to all internal combustion engines which utilize a four stroke cycle. This invention is particularly applicable to diesel engines which require long hours of continuous use. Moreover, the present invention is contemplated to be used in diesel and gasoline engines or with other fuels that are established for use in internal combustion engines. Engines with the modified cycle of the present invention can be widely used in all industrial fields and non-commercial applications, including trucks, passenger cars, industrial equipment, lawn mowers, compressors and others.

Thus, it will be noted that an improved modified cycle for an internal combustion engine has been provided which is of a simple construction with a minimum number of moving parts which will increase power output while running at half the rpms for use wherever conventional internal combustion engines are applicable.

I claim:

1. An internal combustion engine of the type including at least one piston reciprocably mounted within a cylinder bore of the engine, wherein the piston moves through a four-stroke cycle including an intake stroke, a compression stroke, a power expansion stroke and an exhaust stroke, said internal combustion engine comprising:

a crankshaft rotatably mounted to said engine, said crankshaft including guide means for permitting said piston to reciprocate through said four-stroke cycle during a single revolution of said crankshaft, said piston including a follower means extending therefrom to engage with said guide means of said crankshaft, and said guide means having a first reciprocating means defining said exhaust stroke and said intake stroke with equal stroke distances, and a second reciprocating means defining said compression stroke and said power expansion stroke with stroke distances equal to that of the exhaust and intake strokes, wherein said second reciprocating means acts during less than 180° of a single crankshaft revolution and said first reciprocating means acts during the remaining single crankshaft revolution.

2. The internal combustion engine of claim 1, wherein the intake stroke, the compression stroke, the power expansion stroke and the exhaust stroke each have the same stroke distance.

3. The internal combustion engine of claim 1, wherein said first reciprocating means includes a first cam lobe that extends along more than 180° of the crankshaft radial periphery, and said second reciprocating means includes a second cam lobe that extends along at least a portion of the remaining crankshaft radial periphery.

4. The internal combustion engine of claim 3, wherein said first cam lobe and said second cam lobe extend radially outward from the crankshaft for an equal distance, thereby defining an equal piston stroke distance for each of the cycle strokes.

5. The internal combustion engine of claim 4, wherein said second cam lobe extends over no more than 90° of the crankshaft radial periphery thereby resulting in a quick compression and expansion stroke, and the first cam lobe extends over up to 270° of the crankshaft radial periphery thereby resulting in a longer exhaust and intake stroke.

6. The internal combustion engine of claim 5, wherein said first and second cam lobes together define a continuous guide edge that said follower means of said piston rides along as said crankshaft is rotated, and said follower means has a surface to engage said guide edge.

7. The internal combustion engine of claim 6, wherein said surface of said follower means is provided on a roller that is rotatably mounted to a connecting rod extending from said piston.

8. The internal combustion engine of claim 7, further including a bias means for urging said piston inward toward said crankshaft to keep said surface of said follower means against said guide edge during rotation of said crankshaft.

9. The internal combustion engine of claim 8, wherein said bias means comprises a link pivoted at a first end to said engine and pivoted at a distal end to said connecting rod, and a camshaft rotatably mounted to said engine and drivingly connected to said crankshaft, said camshaft including at least one lobe that engages said link to force said piston inward while said roller moves along said guide edge.

10. The internal combustion engine of claim 9, wherein said camshaft and said crankshaft rotate relative to each other in a 1:1 ratio.

11. An internal combustion engine of the type including at least one piston reciprocably mounted within a cylinder bore of the engine, wherein the piston moves through a four-stroke cycle including an intake stroke, a compression stroke, a power expansion stroke and an exhaust stroke, said internal combustion engine comprising:

a crankshaft rotatably mounted to said engine, said crankshaft including guide means for permitting said piston to reciprocate through said four-stroke cycle during a single revolution of said crankshaft, said piston including a follower means extending therefrom to engage with said guide means of said crankshaft, and said guide means having a first reciprocating means defining said exhaust stroke and said intake stroke with equal stroke distances, and a second reciprocating means defining said compression stroke and said power expansion stroke with stroke distances equal to that of the exhaust and intake strokes, wherein said second reciprocating means acts over less of a single crankshaft revolution than the first reciprocating means.

12. The internal combustion engine of claim 11, wherein said first reciprocating means includes a first cam lobe that extends along more than 180° of the crankshaft radial periphery, and said second reciprocating means includes a second cam lobe that extends along at least a portion of the remaining crankshaft radial periphery.

13. The internal combustion engine of claim 12, wherein said first cam lobe and said second cam lobe extend radially outward from the crankshaft for an equal distance, thereby defining the equal stroke distance for each of the cycle strokes.

14. The internal combustion engine of claim 13, wherein said second cam lobe extends over no more than 90° of the crankshaft radial periphery thereby resulting in a quick compression and expansion stroke, and the first cam lobe extends over up to 270° of the crankshaft radial periphery thereby resulting in a longer exhaust and intake stroke.

15. The internal combustion engine of claim 14, wherein said first and second cam lobes together define a continuous guide edge that said follower means of said piston rides along as said crankshaft is rotated, and said follower means has a surface to engage said guide edge.

16. The internal combustion engine of claim 15, wherein said surface of said follower means is provided on a roller that is rotatably mounted to a connecting rod extending from said piston.

17. The internal combustion engine of claim 16, further including a bias means for urging said piston inward toward said crankshaft to keep said surface of said follower means against said guide edge during rotation of said crankshaft.

18. The internal combustion engine of claim 17, wherein said bias means comprises a link pivoted at a first end to said engine and pivoted at a distal end to said connecting rod, and a camshaft rotatably mounted to said engine and drivingly connected to said crankshaft, said camshaft including at least one lobe that engages said link to force said piston inward while said roller moves along said guide edge.

19. The internal combustion engine of claim 18, wherein said camshaft and said crankshaft rotate relative to each other in a 1:1 ratio.

* * * * *